US009493327B2

(12) United States Patent
Ralls et al.

(10) Patent No.: US 9,493,327 B2
(45) Date of Patent: Nov. 15, 2016

(54) PORTABLE LIFTING RIG

(71) Applicant: Huntington Ingalls, Inc., Newport News, VA (US)

(72) Inventors: John W. Ralls, Newport News, VA (US); Matthew J. Absi, Newport News, VA (US); Charles C. Smith, Newport News, VA (US); Randall L. Durham, Newport News, VA (US); Kenneth D. Evanson, Newport News, VA (US); John C. Vandenberg, Newport News, VA (US)

(73) Assignee: Huntington Ingalls Incorporated, Newport News, VA (US)

( * ) Notice: Subject to any disclaimer, the term of this patent is extended or adjusted under 35 U.S.C. 154(b) by 0 days.

(21) Appl. No.: 14/476,181

(22) Filed: Sep. 3, 2014

(65) Prior Publication Data

US 2015/0060632 A1 Mar. 5, 2015

Related U.S. Application Data

(60) Provisional application No. 61/873,436, filed on Sep. 4, 2013.

(51) Int. Cl.
*B66C 19/02* (2006.01)
*B66C 5/02* (2006.01)

(52) U.S. Cl.
CPC *B66C 19/02* (2013.01); *B66C 5/02* (2013.01)

(58) Field of Classification Search
CPC ..... B66C 5/00; B66C 5/02; B66C 5/04; B66C 17/00; B66C 17/04; B66C 17/06; B66C 17/20; B66C 19/00; B66C 19/02; B66C 23/00; B66C 23/18; B66C 23/20; B66C 23/208; B66C 23/24; B66C 23/26; B66C 23/201; B66C 23/202
USPC ..... 212/175, 179, 312, 324; 248/200.1
See application file for complete search history.

(56) References Cited

U.S. PATENT DOCUMENTS 2,772,004 A 11/1956 Noble
5,337,908 A * 8/1994 Beck, Jr. ..... A61G 7/1015 104/126
7,066,343 B1 6/2006 Khachaturian
7,604,134 B2 10/2009 Lichinchi

OTHER PUBLICATIONS

PCT International Search Report for International Application No. PCT/US2014/053993, Dec. 9, 2014, 2 pages.

* cited by examiner

*Primary Examiner* — Sang Kim
*Assistant Examiner* — Juan Campos, Jr.
(74) *Attorney, Agent, or Firm* — Hunton & Williams LLP

(57) ABSTRACT

A portable lifting device is provided that includes a pair of telescoping parallel beam assemblies attached on either end to a pair of stanchion assemblies. Each stanchion assembly includes a top and bottom member as well as at least one vertical member. The bottom member of each beam assembly rests on a deck support member, and the height of each vertical member may be adjustable. A sliding guide assembly is slidably mounted on the parallel beam assemblies and includes a cross-member between the parallel beams that acts as the connection point for a lifting medium. This allows for a higher support point for the lifting medium than would be provided by a conventional single-beam device.

19 Claims, 10 Drawing Sheets

PORTABLE LIFTING RIG

REFERENCE TO RELATED APPLICATION

This application claims priority to U.S. Provisional Patent Application 61/873,436, filed on Sep. 4, 2013, the complete disclosure of which is incorporated herein by reference.

FIELD OF THE INVENTION

The invention relates generally to the field of lifting devices, and more particularly to a portable lifting rig for use in areas with limited vertical or overhead space.

BACKGROUND

During construction and, in some instances, operation, of maritime vessels, occasional heavy lifting tasks may be required in confined areas with limited vertical space. Permanent lifting rigs in all such spaces would be impractical and costly. Thus, there is a need for a lifting rig that can be readily moved and temporarily installed in such spaces and that is capable of operation using as little vertical space as possible.

SUMMARY OF THE INVENTION

The present invention provides lightweight, modular devices that may be adjustable for use in conjunction with typical building and/or shipboard structures. Some embodiments of the invention provide for adjustable span and height for use in areas having a variety of dimensions. In an illustrative embodiment of the invention, a portable lifting device comprises a pair of stanchion assemblies, each comprising a stanchion assembly base member, a stanchion assembly top member, and at least one vertical stanchion having a lower end engaging and being supported by the base member and an upper end engaging and supporting the top member. The device further comprises a plurality of parallel beam assemblies, each having a first beam assembly end removably attached to a first one of the stanchion assembly top members and a second beam assembly end removably attached to a second one of the stanchion assembly top members. The device further comprises a guide assembly that includes a plurality of collars connected by at least one guide assembly cross member, each collar being slidably mounted to one of the parallel beam assemblies so that the guide assembly is slidable along an axis parallel to the beam assemblies.

BRIEF DESCRIPTION OF THE DRAWINGS

The invention can be more fully understood by reading the following detailed description together with the accompanying drawings, in which like reference indicators are used to designate like elements, and in which.

DESCRIPTION OF THE INVENTION

Figure 1:
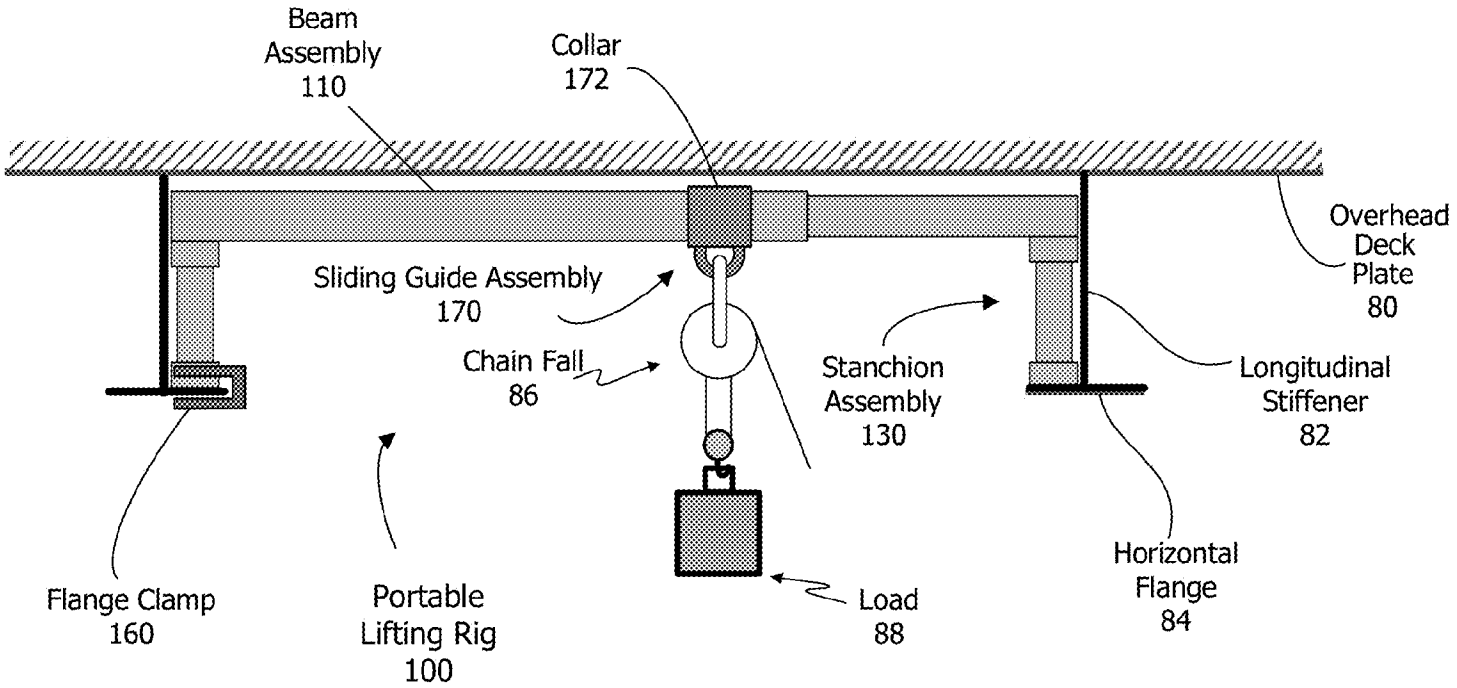
FIG. 1 is a schematic illustration of a portable lifting rig according to an exemplary embodiment of the invention.

The present invention takes advantage of existing horizontal support beams or stiffeners used to support a deck plate or other structure (e.g., ceiling, floor, roof, etc.) in a ship, building or other construction. FIG. 1 provides a schematic illustration of a shipboard use of the device of the invention in a below-decks compartment. The deck above the compartment is supported at least in part by a pair of longitudinal stiffeners 82 each having a vertical web and a horizontal flange 84. The device is an overhead lifting rig 100 that uses a pair of parallel telescoping beam assemblies 110 (only one of which is visible in the side view of FIG. 1) supported by stanchion assemblies 130 that rest on the horizontal flanges 84 of the longitudinal stiffeners 82. Each stanchion 130 has a flat base that sits on the top of a shipboard longitudinal member (e.g., on the horizontal flange 84 as shown in FIG. 1) or any other horizontal support surface.

Figure 2A:
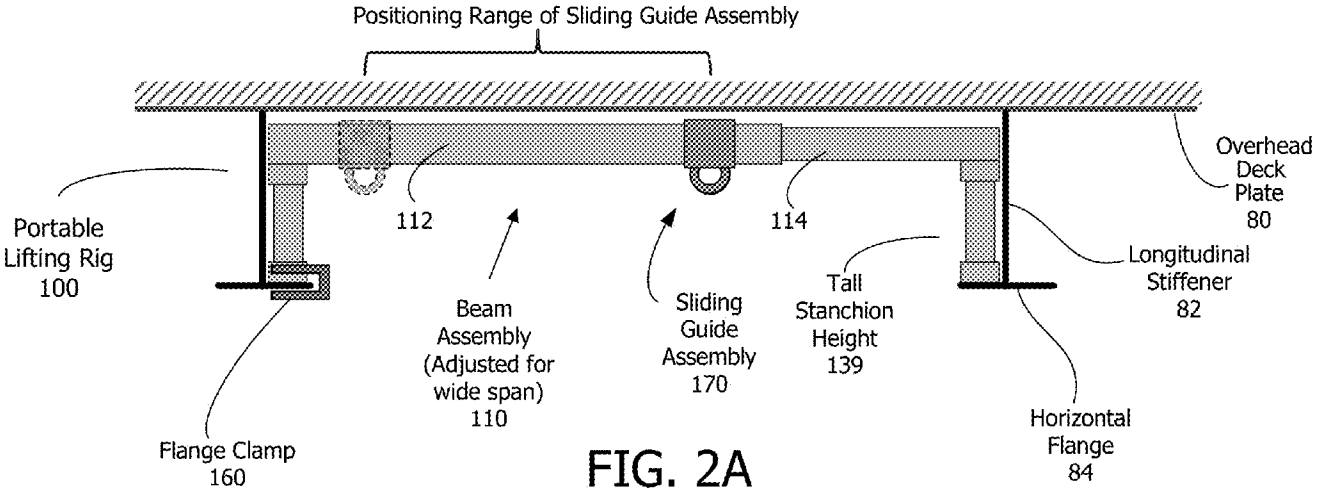
FIGS. 2A and 2B are schematic illustration of a portable lifting rig according to an exemplary embodiment of the invention.
Figure 2B:
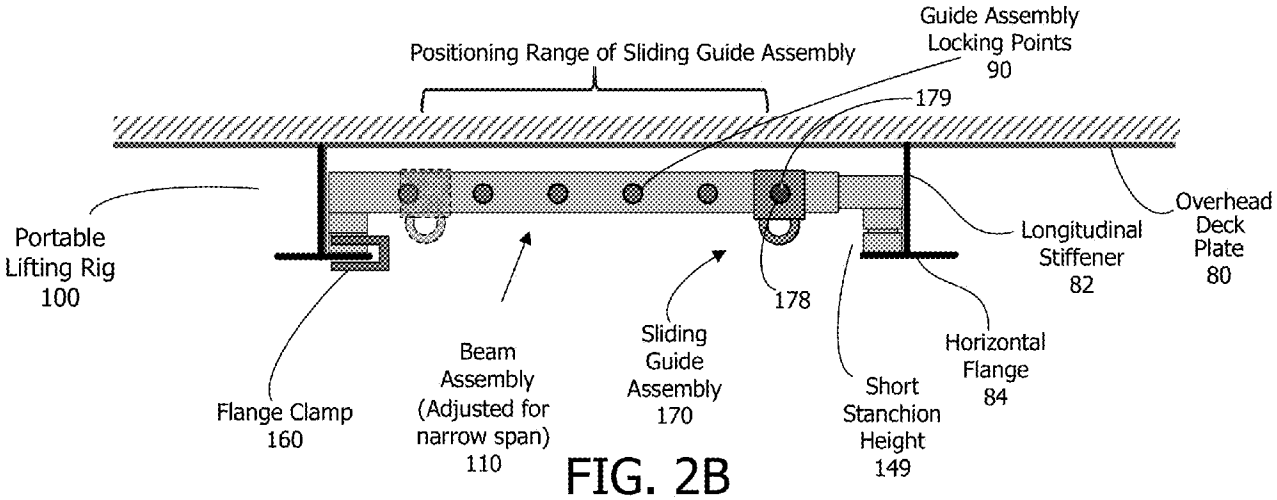

The telescoping beam assemblies 110 are each formed by an outer beam member 112 formed as a channel, hollow tube member or pipe configured to slidably receive an inner beam member 114, which may be a solid member, a channel, a hollow tube member, or a pipe. As shown in FIGS. 2A and 2B, the telescoping nature of the beam assemblies 110 allows the device to span varying widths. This allows use of the device in compartments having varied spacing between longitudinal stiffeners 82. The lifting device 100 includes a sliding guide assembly 170 formed by a pair of collars 172 (only one of the two is visible), each configured to slidably receive one of the outside beam members 112. The two collars 172 are connected by a rigid cross-member (not shown) so that the guide assembly 170 slides as a unit along the parallel outer beam members 112. The cross-member may be configured as a padeye or other attachment fixture for use in suspending a lifting medium (e.g., a chain lift 86 as shown in FIG. 1 or other hoist mechanism, a pulley, a simple strand/chain, or any other suspended device). Significantly, the position of the cross-member between the parallel beams 110 allows for a higher support point for the lifting medium than would be provided by a conventional single-beam device. This serves to maximize the height to which a given load 88 can be lifted.

The sliding guide assembly 170 can be positioned anywhere along the length of the outer portion of the telescoping beams 112. In some embodiments, the sliding guide assembly may be secured in a selected position using set-screws or other suitable securing mechanism. In some embodiments, the lifting rig of the invention may include locking mechanisms (e.g., pins, bolts or other fasteners) for locking the guide assembly 170 in a selected position and/or for locking the overall extension length of the telescoping beams. For example, outer beam member 112 in FIG. 2B includes multiple guide assembly locking points 90 that can be aligned with locking point 178 on sliding guide assembly 170 and locked by inserting a pin 179 through the locking point 178 and guide assembly locking point 90. The locking mechanisms may be configured to allow selection from a finite set of predetermined locking positions or may be configured to allow for placement/adjustment anywhere between predetermined boundaries. The device may also include a clamp mechanism 160 connected to the base of one or both of the stanchion assemblies 130. The clamp mechanism 160 is configured to hold the stanchion base member to the horizontal flange 84.

As will be discussed in more detail hereafter, the lifting rig of the invention may be formed from a series of easily assembled modular members. These may be assembled to one another using pins or other fasteners. The various members may be formed from any suitable material providing the requisite strength to support the desired loads. In certain embodiments, some or all of the structural members (beam members, stanchions, and cross-members) are formed from aluminum or aluminum alloy.

As illustrated in FIGS. 2A and 2B, the height of the lifting rig device may be adapted according to the distance between the horizontal flange 84 of the deck support member and the deck plate 80 supported by the longitudinal stiffener 82. This can be accomplished through the use of vertical stanchion members having different lengths (e.g., tall stanchion 139 or short stanchion 149) or by using variable length vertical stanchion members (e.g., stanchions formed by telescoping members). The variability of device height again serves to maximize the support height for the lifting medium, which, in turn, maximizes the height to which a given load can be raised within a compartment or hangar area.

The lifting rig of the present invention is not limited to any particular size or load capacity. The specific size and configuration (e.g., cross-sectional geometry) of the various members may be determined using known methods based on the materials used, the range of span and height variation of the device and the desired loading scenarios. Typical devices formed primarily from aluminum and with maximum spans ranging from 28 inches to 80 inches have been constructed and have demonstrated lift capabilities of at least 1500 pounds. The span range of each individual device is dependent on load factors and potential deflection. Typical size ranges for individual devices with proofed capacities up to 1500 pounds:

| Span | Rig Weight |
|---|---|
| 20 inches to 28 inches | 35-40 lbs |
| 38 inches to 48 inches | 45-55 lbs |
| 68 inches to 80 inches | 65-75 lbs |

Figure 3:
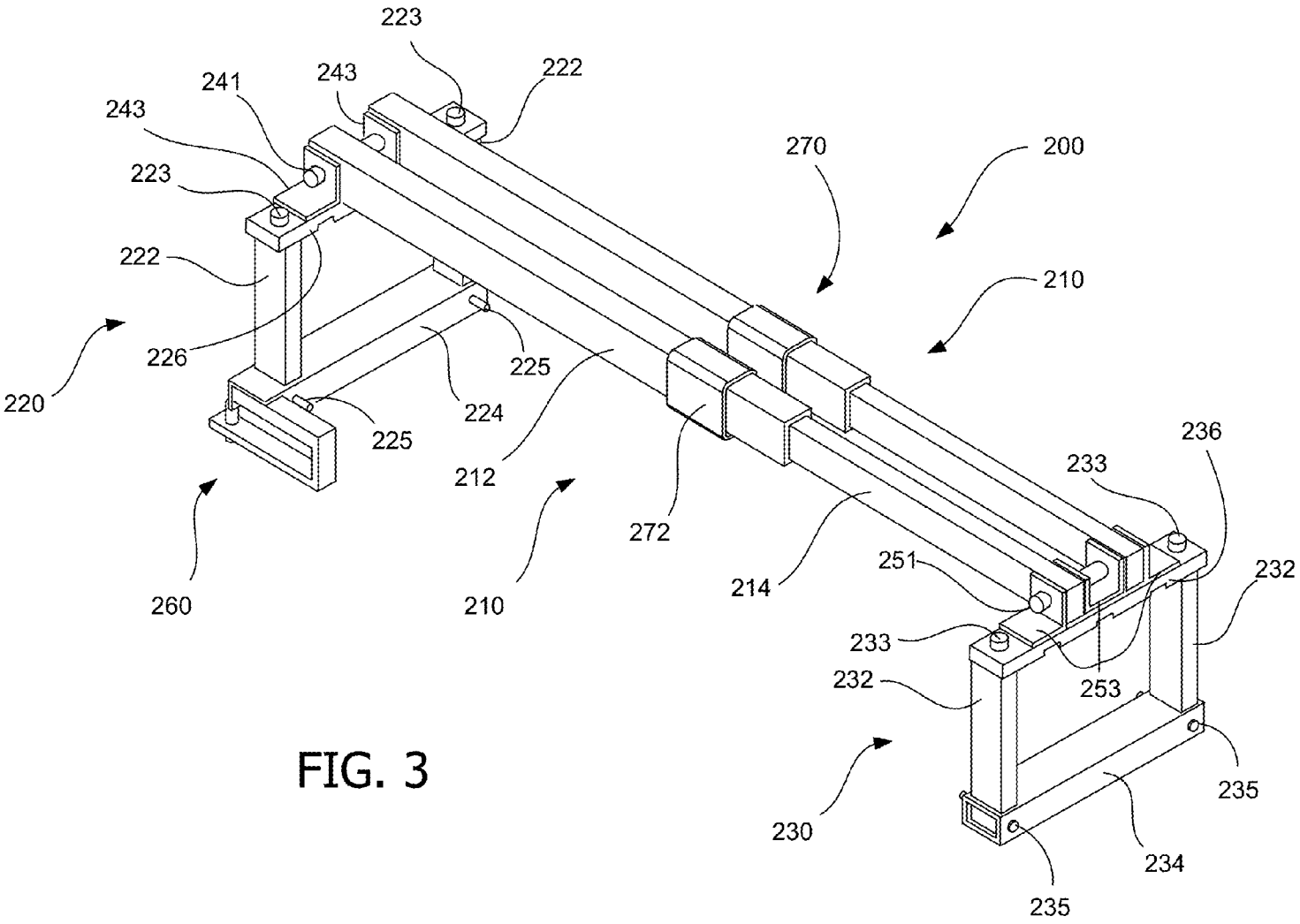
FIG. 3 is a perspective view of a lifting rig according to an embodiment of the invention.
Figure 4:
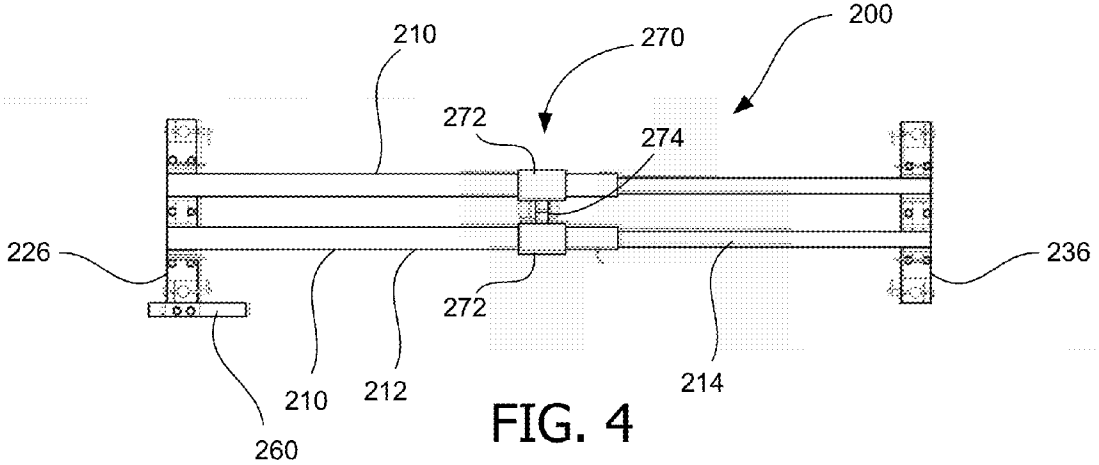
FIG. 4 is a top view of a lifting rig according to an embodiment of the invention.
Figure 5:
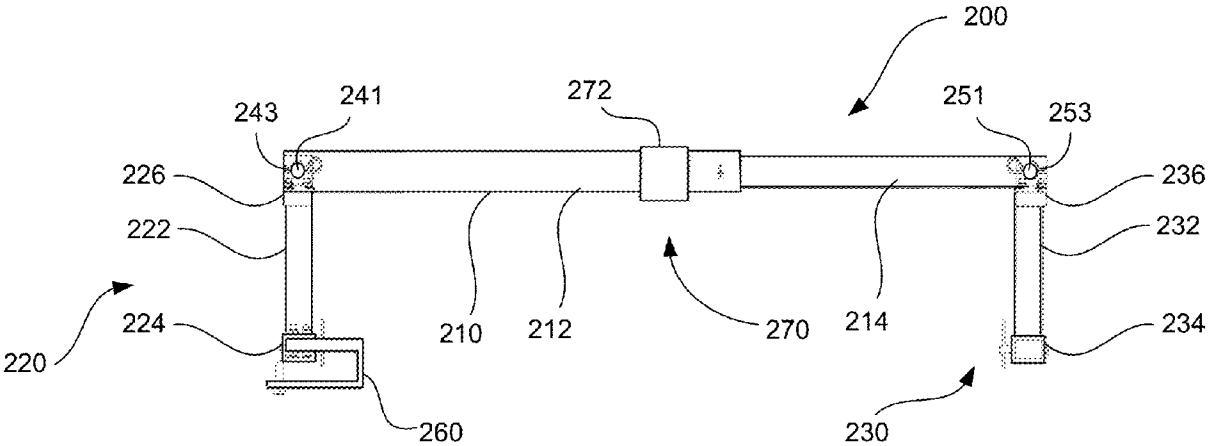
FIG. 5 is a front view of the lifting rig shown in FIG. 4.
Figure 7:
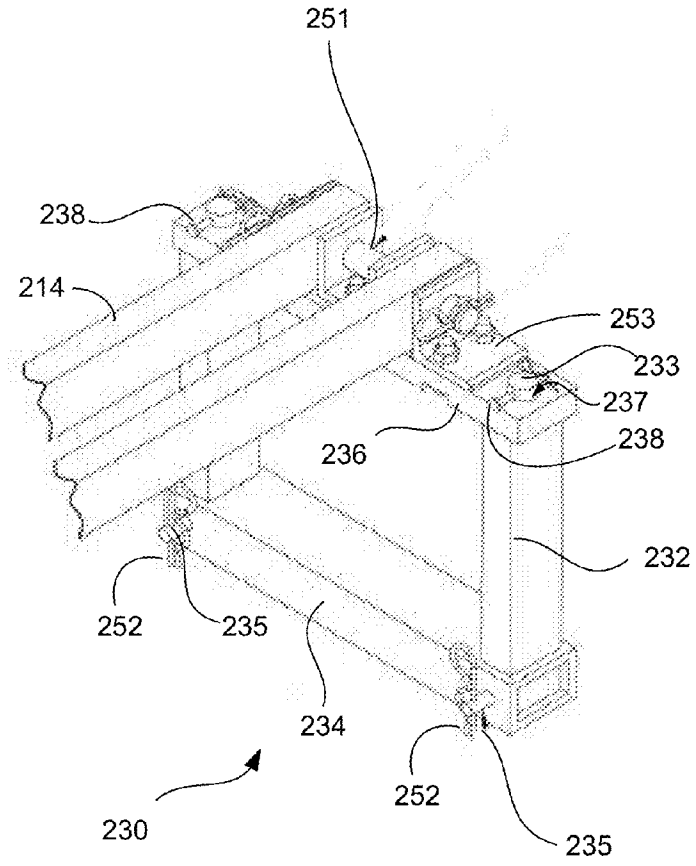
FIG. 7 is a perspective view of a portion of the lifting rig shown in FIG. 4.
Figure 6:
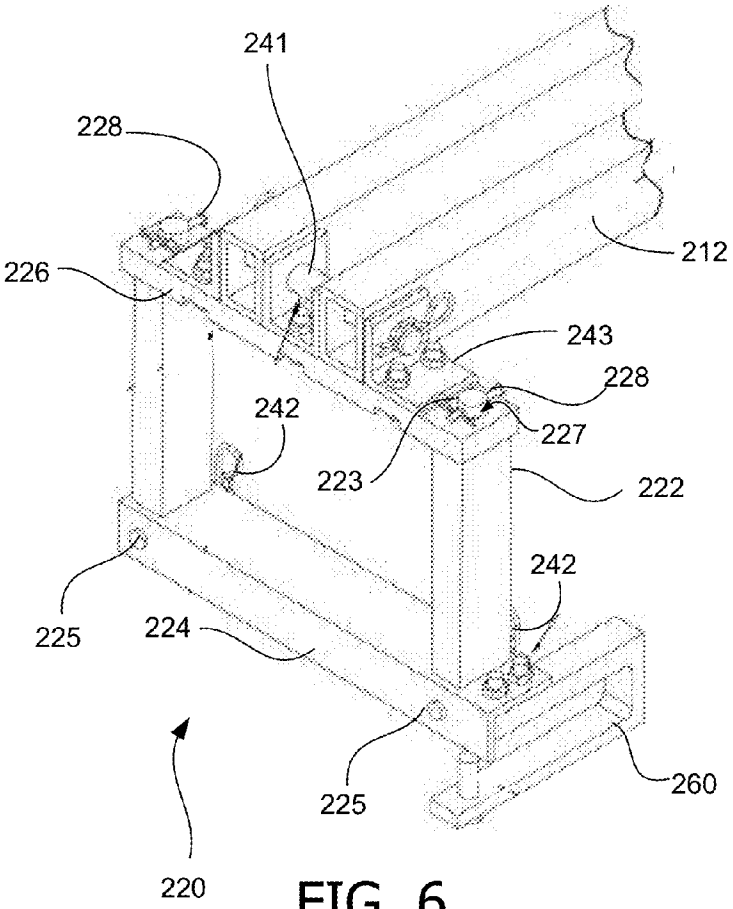
FIG. 6 is a perspective view of a portion of the lifting rig shown in FIG. 4.

Exemplary embodiments of the lifting rig of the current invention will now be discussed in more detail with reference to FIGS. 3-8. FIG. 3 illustrates a lifting rig 200 having a pair of parallel beam assemblies 210 supported by first and second stanchion assemblies 220, 230. Each of the beam assemblies includes an outer beam member 212 and an inner beam member 214. The outer beam member 212 is formed as a channel or hollow member configured to receive the inner beam member 214 in a slidable telescoping manner.

Figure 11:
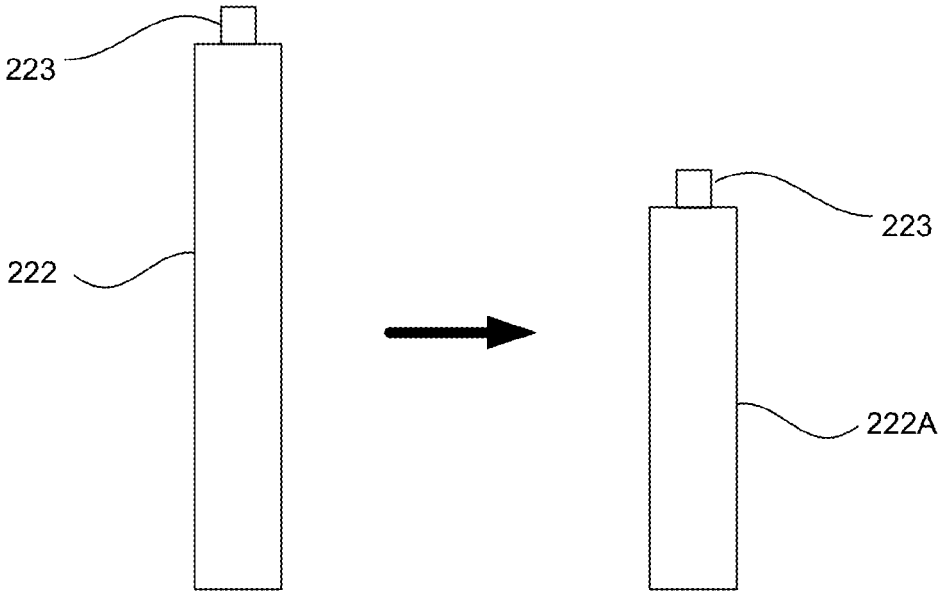
FIG. 11 is a front view of two stanchions usable in a portable lifting rig according to an embodiment of the invention.
Figure 12:
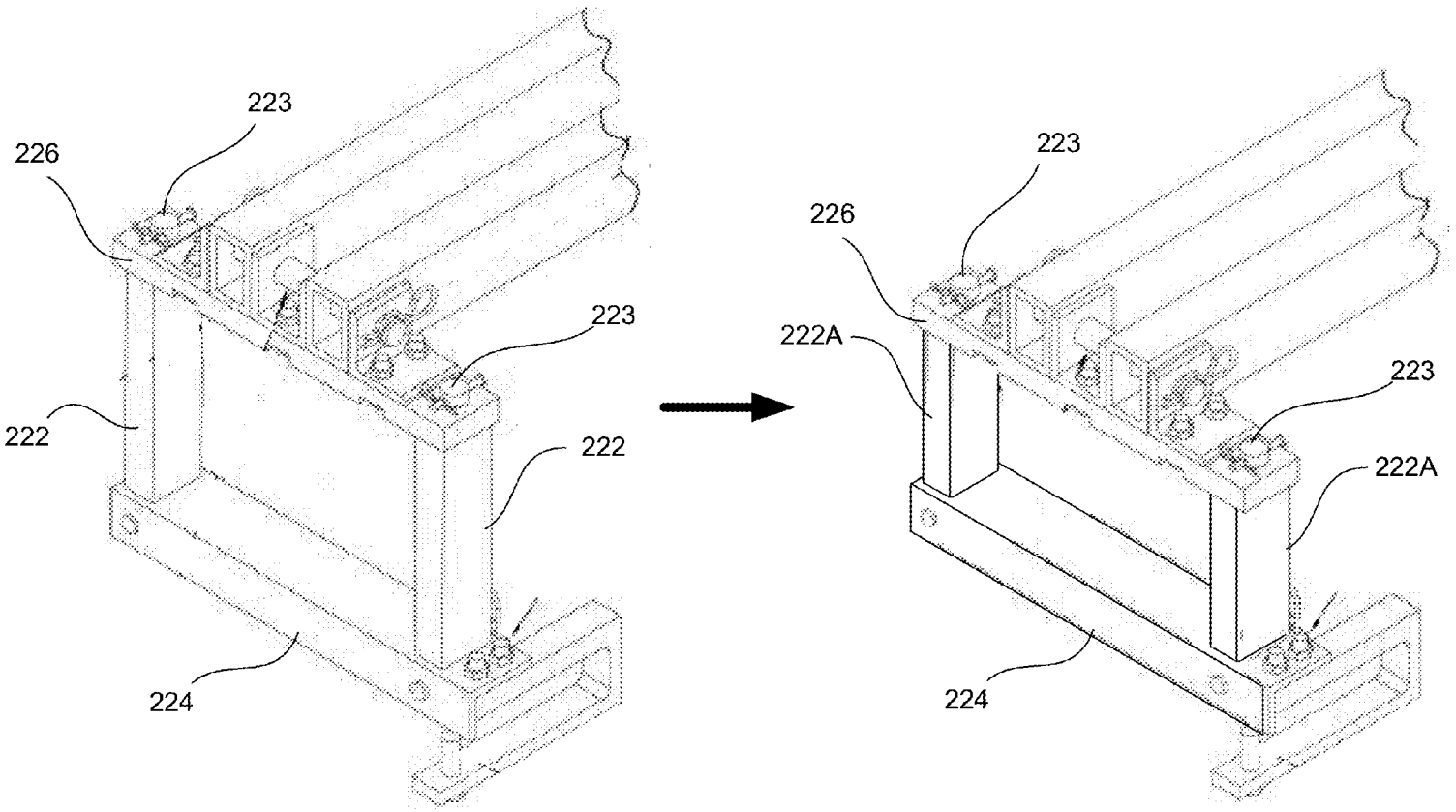
FIG. 12 shows a first perspective view of a portion of a portable lifting rig having a first stanchion length and a second perspective view of a portion of the same portable lifting rig having a second stanchion length.

The ends of both beam assemblies 210 are supported by the stanchion assemblies 220, 230. These assemblies each include two stanchions 222, 232, a base cross-member 224, 234 and a top cross-member 226, 236. In some embodiments like that shown in FIGS. 3-8, these are all separate members that are removably attached to one another. In the illustrated embodiment, the stanchions 222, 232 are each formed as a solid member rectangular prism with a rod-like machined connection interface 223, 233 extending from one end that is configured to extend through a cylindrical passage 227, 237 formed through the top cross-member 226, 236. The stanchions 222, 232 are attached to the top cross-member 226, 236 by inserting the connection interface 223, 233 through the passage 227, 237, and inserting a pin 228, 238 through a lateral hole through the rod 223, 233. (See FIGS. 6 and 7.) As previously discussed, the height of the portable lifting device can be adjusted by replacing the stanchions 222, 232 with stanchions having a different length (e.g., the shorter stanchions 222A shown in FIGS. 11 and 12).

The base cross-member 224, 234 may be formed as a hollow rectangular member having a passage formed in its upper surface and configured for receiving the bottom portion of the stanchion 222, 232. The stanchion 222, 232 is attached to the base cross-member 224, 234 by inserting the bottom of the stanchion 222, 232 into the rectangular passage and inserting a bolt or rod 225, 235 through a lateral passage formed through the walls of the base cross-member 224, 234 and the stanchion 222, 232 and inserting a pin 242, 252 through a lateral hole through the rod 225, 235. (See FIGS. 6 and 7.)

The ends of the beam assemblies 210 may be attached to the top cross-member 226, 236 of the stanchion assemblies 220, 230 in a similar manner. In the illustrated embodiment, a single rod 241, 251 is passed through lateral holes in both beam members and a series of angle stock members 243, 253 bolted to the upper surface of the top cross-member 226, 236. A pin may be used at one or both ends of the rod 241, 251 to hold the rod 241, 251 in place.

The lifting rig 200 may include one or more clamp assemblies 260 attached to one or both base cross-members 224, 234. In many cases, as in the illustrated embodiment, only a single clamp assembly 260 is required. The clamp assembly 260 is attached to one end of the first base cross-member 224 and is configured to selectively clamp the first base cross member 224 to a planar surface on which the first base cross member 224 is resting. A similar clamp assembly could optionally be provided on the other end of the first base cross member 224 and/or on one or both ends of the second base cross-member 234.

Figure 8:
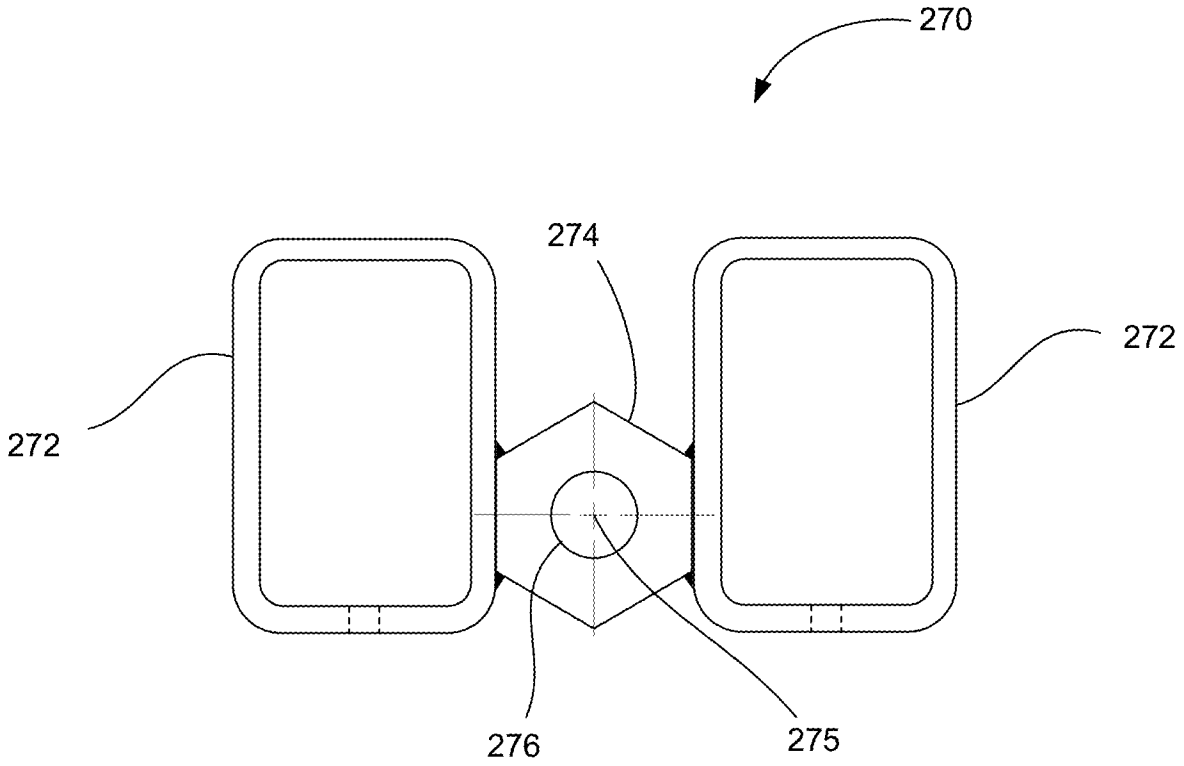
FIG. 8 is an end view of a guide assembly usable in embodiments of the invention.

FIG. 8 illustrates a guide assembly 270 formed by a pair of collars 272, each configured to slidably receive one of the outer beam members 212. The two collars 272 are connected by a rigid guide cross-member 274. In the illustrated embodiment, the guide cross-member 274 is configured as a hexagonal padeye having a cylindrical passage 276, with a passage axis 275 parallel to the parallel beam assemblies, formed therethrough to form the support point for and allow attachment of a lifting medium. It will be understood that the guide cross member 274 is not limited to the illustrated configuration and can be tailored to particular applications.

When assembled, the guide assembly 270 is configured to slide along the parallel outer beam members 212 to a desired location. Any of various locking mechanisms can be used to secure the guide assembly to a desired locations. These may include, inter alia, rods inserted through passages formed through the sides of the collars and in preselected locations along the beam members (e.g., as shown in FIG. 2B). Similar locking mechanisms may be used to secure the relative positions of the inner and outer beam members.

Figure 10:
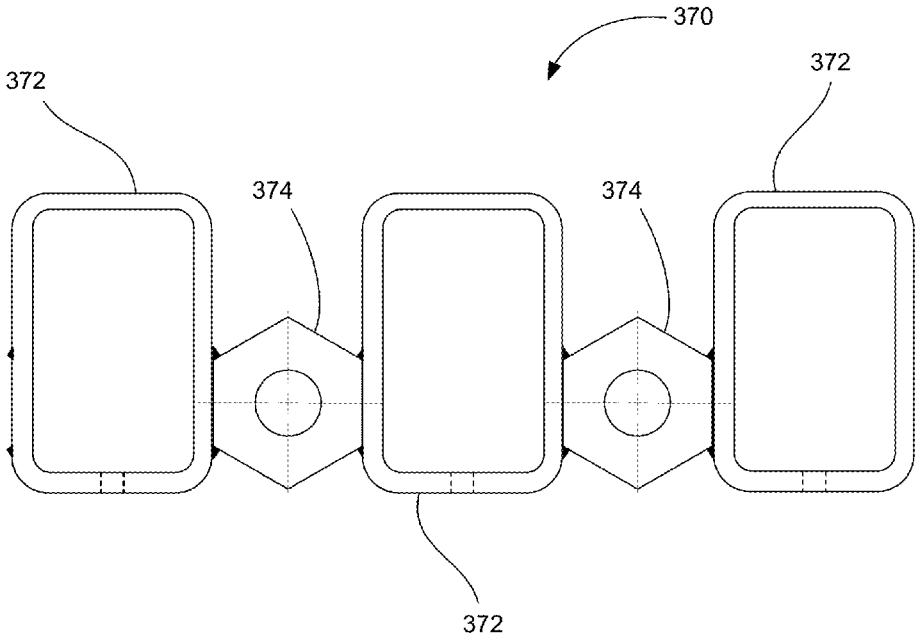
FIG. 10 is an end view of a guide assembly usable in embodiments of the invention.

While the illustrative embodiments show two parallel beam assemblies, it will be understood that any number of parallel beam assemblies may be used. For example, a lifting rig according to a particular embodiment includes three parallel beam assemblies supported by stanchion assemblies similar to those shown in FIGS. 1-7. With reference to FIG. 10, the lifting rig of this embodiment has a guide assembly 370 that has three collars 372 connected by two guide assembly cross members 374. Each collar 372 is slidably mounted to one of the three beam assemblies. Such an embodiment allows the distribution of a lift load over three beam assemblies and provides two lift points These features may be used to increase the lift capability of the rig.

It will be understood that any number of parallel beam assemblies can be used. Further, the modularity of the lift rig can allow the number of beam assemblies to be varied for a single rig. For example, the stanchion assemblies may be configured to allow attachment of one beam assembly or two or three parallel beam assemblies depending on the needed capacity.

It will also be understood that multiple lift rigs according to the invention may be used together to provide increased lift capacity.

The lifting rig of the invention may be readily dismantled into its modular parts and reassembled in a new position. When reassembled, the rig may be adjusted in span and height according to the spacing and flange height of the support beams in the new location. It will be understood that the utility of the lifting device is not limited to the specific use in relation to deck or floor support beams. The rig may be secured to any suitable supporting surface, beams, posts or columns.

Figure 9:
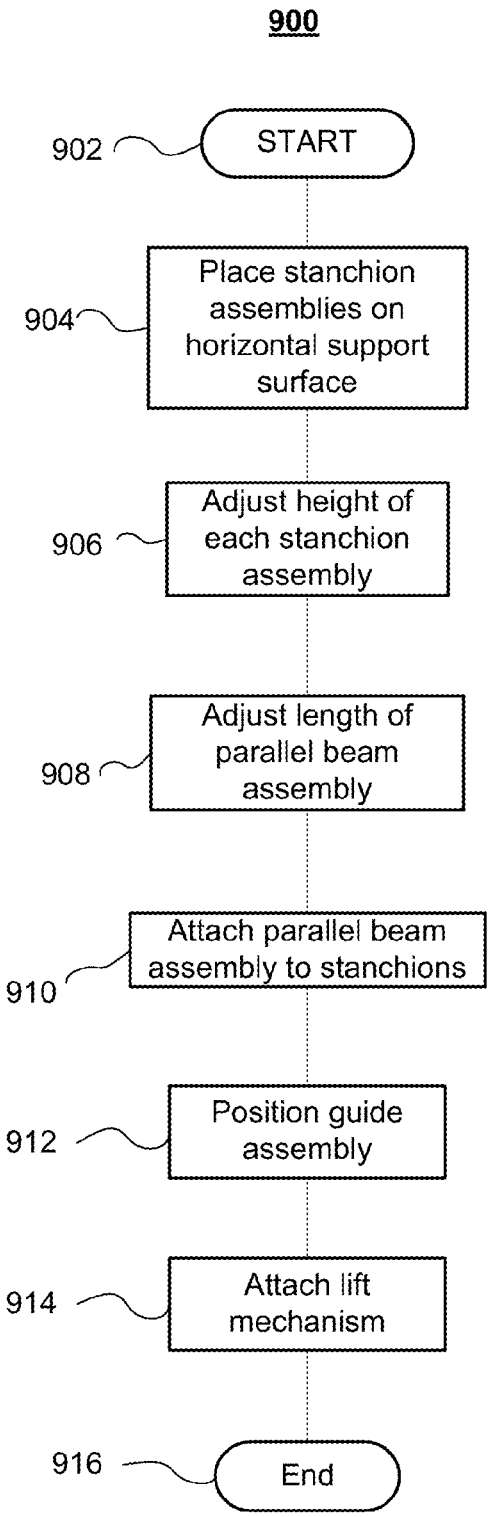
FIG. 9 is a block diagram of a method of assembling a portable lifting rig according to a particular embodiment of the invention.

FIG. 9 is a block diagram illustrating an exemplary method for assembling a portable lift rig, according to a particular embodiment. The method 900 shown in FIG. 9 can be executed or otherwise performed by one or more combinations of various systems. The method 900 as described below may be carried out using the portable lift rig 100 shown in FIGS. 1-8, by way of example, and various elements of the aforementioned apparatus are referenced in explaining the method of FIG. 9. Each block shown in FIG. 9 represents one or more processes, methods, or subroutines in the exemplary method 900. Referring to FIG. 9, the exemplary method 900 begins at 902. At 904, the first and second stanchion assemblies may be placed on longitudinal stiffeners across from each other. Each stanchion assembly may have a flat base that sits on the horizontal flange of a longitudinal stiffener which supports a deck compartment. At 906, the height of each stanchion assembly may be adjusted based on the available vertical clearance or desired range of lift capability. The height of each stanchion assembly may be adjusted before the lift rig is placed on the horizontal support surface.

At 908, the length of the parallel beam assemblies are adjusted based on the distance between the first and second stanchion assemblies. 908 could include mounting the sliding guide assembly to the parallel beam assemblies. At 910, the ends of the parallel beam assembly are attached to the top members of the first and second stanchion assemblies. At 912, the sliding guide assembly may be positioned along the parallel beam assemblies. At 914, a lift mechanism is attached to the attachment point of the collar cross-member. The lift mechanism may include a chain fall or other hoist mechanism, a pulley, a simple strand/chain, or any other suspended device. The lifting rig of the invention may also include locking mechanisms (e.g., pins, bolts or other fasteners) for locking the guide assembly in a selected position and/or for locking the overall extension length of the telescoping beams. The method 900 ends at 916. The examples contained herein are offered by way of illustration and not by any way of limitation.

Although the invention has been described in some detail by way of illustration and example for purposes of clarity of understanding, it should be understood that certain changes and modifications may be practiced within the scope of the appended claims. Modifications of the above-described modes for carrying out the invention that would be understood in view of the foregoing disclosure or made apparent with routine practice or implementation of the invention to persons of skill in food chemistry, food processing, mechanical engineering, and/or related fields are intended to be within the scope of the following claims.

What is claimed is:

1. A portable lifting device comprising:

a pair of stanchion assemblies, each comprising a stanchion assembly base member, a stanchion assembly top member, and at least one vertical stanchion having a lower end engaging and being supported by the base member and an upper end having an upward facing surface engaging and supporting the top member;

a plurality of parallel beam assemblies, each having a first beam assembly end removably attached to a first one of the stanchion assembly top members and a second beam assembly end removably attached to a second one of the stanchion assembly top members; and a guide assembly comprising a plurality of collars connected by at least one guide assembly cross member, each collar of the plurality of collars being slidably mounted to one of the parallel beam assemblies so that the guide assembly is slidable along an axis parallel to the beam assemblies, wherein each collar of the plurality of collars surrounds the one of the parallel beam assemblies to which said collar is mounted.

2. A portable lifting device according to claim 1, wherein each parallel beam assembly comprises a hollow outer beam member having a first outer beam end removably attached to a first one of the stanchion assembly top members and a second outer beam end; and an inner beam member having a first inner beam end slidably disposed within the outer beam member through the second outer beam end and a second inner beam end removably attached to a second one of the stanchion assembly top members.

3. A portable lifting device according to claim 2, wherein each guide assembly collar is slidably mounted to one of the outer beam members.

4. A portable lifting device according to claim 2 further comprising:

a beam locking mechanism configured to selectively lock the inner beam member in a horizontal position relative to the outer beam member.

5. A portable lifting device according to claim 1, wherein each stanchion assembly comprises two parallel, spaced apart vertical stanchions, the stanchion assembly base member being engaged by and supporting the lower ends of the two parallel vertical stanchions, and the stanchion assembly top member being engaged and supported by the upper ends of the two parallel vertical stanchions.

6. A portable lifting device according to claim 1, wherein the vertical stanchions have an identical first length and wherein the lifting device is configured so that a height of the lifting device can be adjusted by disassembling the lifting device and reassembling the lifting device with second vertical stanchions having an identical second length that is different from the first length.

7. A portable lifting device according to claim 1, wherein the at least one vertical stanchion of each stanchion assembly comprises:

a hollow outer vertical stanchion member having a first outer vertical stanchion end removably attached to a stanchion assembly base member and a second outer vertical stanchion end; and an inner vertical stanchion member having a first inner vertical stanchion end slidably disposed within the outer vertical stanchion member through the second outer vertical stanchion end and a second inner vertical stanchion end removably attached to a stanchion assembly top member.

8. A portable lifting device according to claim 1, wherein each of the at least one guide assembly cross member comprises an attachment fixture for use in suspending a lifting medium.

9. A portable lifting device according to claim 8, wherein the attachment fixture comprises a padeye having a horizontal padeye passage formed therethrough along a passage axis parallel to the beam assemblies.

10. A portable lifting device according to claim 9, wherein the passage axis is above a bottom-most surface of the parallel beam assemblies.

11. A portable lifting device according to claim 1, further comprising a locking mechanism for selectively locking the guide assembly in a selected position relative to the parallel beam assemblies.

12. A portable lifting device according to claim 1, further comprising at least one clamp assembly attached to a stanchion assembly base member and being configured to secure the stanchion assembly base member to a planar support surface.

13. A portable lifting device according to claim 1, wherein the plurality of parallel beam assemblies consists of two parallel beam assemblies and the guide assembly has a pair of collars connected by one guide assembly cross member.

14. A portable lifting device comprising:

a pair of spaced apart stanchion assemblies, each comprising at least one vertical stanchion;

a first beam assembly removably attached to the stanchion assemblies;

a second beam assembly removably attached to the stanchion assemblies;

a guide assembly comprising a first collar slidably mounted to the first beam assembly and a second collar slidably mounted to the second beam assembly, the first and second collars being connected by a first guide assembly cross member, wherein the first collar surrounds the first beam assembly and the second collar surrounds the second beam assembly.

15. A portable lifting device according to claim 14 further comprising:

at least one additional beam assembly removably attached to the stanchion assemblies, each of the at least one additional beam assembly being parallel to the first and second beam assemblies, wherein the guide assembly comprises, for each of the at least one additional beam assembly, an additional collar slidably mounted to the additional beam assembly and connected to the first and second collars by an additional guide assembly cross member, each additional collar surrounding the additional beam assembly to which said additional collar is mounted.

16. A method of assembling and positioning a portable lifting device having a plurality of parallel length-adjustable beam assemblies supported by first and second stanchion assemblies each comprising a base member supporting at least one vertical stanchion member having an adjustable height and a top member, and a guide assembly comprising a plurality of collars and a guide assembly cross member, each collar being slidably mountable to one of the parallel beam assemblies with the collar surrounding said parallel beam assembly, the method comprising:

placing the first stanchion assembly on a first horizontal support surface;

placing the second stanchion assembly on a second horizontal support surface horizontally spaced apart from the first stanchion assembly by a first distance;

adjusting the height of each of the at least one stanchion assemblies;

adjusting the parallel beam assemblies to a length sufficient to span the first distance;

mounting the guide assembly to the parallel beam assemblies so that each collar receives a respective parallel beam assembly therethrough and so that said collar is supported by and slidable along said respective beam assembly; and attaching a first beam end of each beam assembly to a first top member and attaching a second beam end of each beam assembly to a second top member.

17. A method according to claim 16 further comprising:

attaching a lifting medium to the guide assembly cross member.

18. A method according to claim 17 wherein the lifting medium comprises at least one of the set consisting of a strand, a chain lift, a hoist, and a pulley.

19. A method according to claim 16 further comprising:

adjusting a position of the guide assembly along the length of the parallel beam assemblies.

* * * * *